US009147303B2

(12) United States Patent
Loignon et al.

(10) Patent No.: US 9,147,303 B2
(45) Date of Patent: Sep. 29, 2015

(54) ROTARY HOPPER

(75) Inventors: Marcus Loignon, Marietta, GA (US); David Campbell, Winchester, VA (US)

(73) Assignee: Automated Merchandising Systems Inc., Kearneysville, WV (US)

( * ) Notice: Subject to any disclaimer, the term of this patent is extended or adjusted under 35 U.S.C. 154(b) by 439 days.

(21) Appl. No.: 13/189,055

(22) Filed: Jul. 22, 2011

(65) Prior Publication Data

US 2013/0020348 A1 Jan. 24, 2013

(51) Int. Cl.

| | |
|---|---|
| ***G07F 11/16*** | (2006.01) |
| ***B65G 59/00*** | (2006.01) |
| ***B65H 3/00*** | (2006.01) |
| ***G07F 11/24*** | (2006.01) |
| *G07F 11/00* | (2006.01) |
| *G07F 11/48* | (2006.01) |
| *G07F 1/00* | (2006.01) |

(52) U.S. Cl.

CPC . *G07F 11/24* (2013.01); *G07F 1/00* (2013.01); *G07F 11/005* (2013.01); *G07F 11/48* (2013.01)

(58) Field of Classification Search

CPC ..... G07F 1/00; G07F 11/007; G07F 11/005; A47F 1/87

USPC ..... 221/205, 256, 194, 195, 247, 3, 67, 221/277, 75, 2, 4, 266, 12, 9; 109/48; 179/6.3; 379/153; 194/202; 211/59.2; 62/378

See application file for complete search history.

(56) References Cited

U.S. PATENT DOCUMENTS

| | | | | | |
|---|---|---|---|---|---|
| 353,572 | A * | 11/1886 | Meyers | 221/131 |
| 733,651 | A * | 7/1903 | Hunter | 232/49 |
| 1,120,865 | A * | 12/1914 | Tomaszewaki | 232/49 |
| 1,333,479 | A * | 3/1920 | Farmer | 221/256 |
| 1,841,926 | A * | 1/1932 | Zuehl | 221/75 |
| 2,072,462 | A * | 3/1937 | Mills | 379/153 |
| 2,977,023 | A * | 3/1961 | Meyer | 221/205 |
| 3,161,321 | A * | 12/1964 | Mellion et al. | 221/266 |
| 3,421,657 | A * | 1/1969 | Larson | 221/13 |
| 3,424,345 | A * | 1/1969 | Payne | 221/116 |
| 3,784,090 | A * | 1/1974 | Markham | 232/44 |
| 3,880,320 | A * | 4/1975 | Morello et al. | 221/9 |
| 3,940,016 | A * | 2/1976 | Krakauer | 221/129 |
| 5,375,737 | A * | 12/1994 | Ficken | 221/194 |
| 6,234,345 | B1 * | 5/2001 | Minh et al. | 221/124 |
| 7,651,006 | B2 * | 1/2010 | Krish et al. | 221/48 |
| 7,980,417 | B2 * | 7/2011 | Riley | 221/3 |
| 8,191,730 | B2 * | 6/2012 | Krish et al. | 221/48 |
| 2003/0111478 | A1 * | 6/2003 | Park | 221/21 |

* cited by examiner

*Primary Examiner* — Rakesh Kumar

(57) ABSTRACT

A product retrieval system for vending machines that permits collection of varying size products at a first level yet presents such products for collection at a raised height to make retrieval more convenient. The retrieval system utilizes a rotary hopper that includes an actual bottom as well as a technical or false bottom that does not lower the depth of the rotary hopper in its ability to receive dispensed product on the actual bottom, with the technical bottom presenting the product to a higher retrieval point relative to the floor upon rotation of the rotary hopper to an open condition.

11 Claims, 13 Drawing Sheets

ROTARY HOPPER

COPYRIGHT NOTICE

A portion of the disclosure of this patent document contains material that is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to vending machines and more specifically to a product retrieval system that receives a dispensed product at one level and presents that product at a different and higher level for collection.

INTRODUCTION

Glossary: As used throughout this document:

The term "hopper" and the phrase "rotary hopper" shall mean any form of rotary retrieval bin, for example one having a hollow or open interior, containing a false or technical bottom that will assist in the initial receipt of any sized product that is dispensed from a product tray or other product retaining mechanism in a vending machine into the bin and onto an actual floor within the bin structure, yet will present such a dispensed item on the false or technical bottom at a point higher than the actual floor for collection by a purchaser;

The term "retrieval mechanism" or "retrieval bin mechanism" shall include mean a system that receives dispensed product at a first lower level and when opened presents that dispensed product at a second higher level for collection by the purchaser.

The term "actual floor" or "actual bottom" means the true floor within the rotary hopper of the retrieval mechanism when it is in its closed condition with the depth of the actual floor defined by the vertical dimension across the full interior of the rotary hopper.

The term "false bottom" or "technical bottom" means the effective floor of the rotary hopper within the retrieval mechanism on which a dispensed product rests and is ready for collection when the rotary hopper is in its open condition.

DESCRIPTION OF PRESENTLY PREFERRED EXAMPLES OF THE INVENTION

Brief Description of Figures

The invention is better understood by reading the following detailed description with reference to the accompanying drawings in which.

DESCRIPTION

A. Overview

Figure 1:
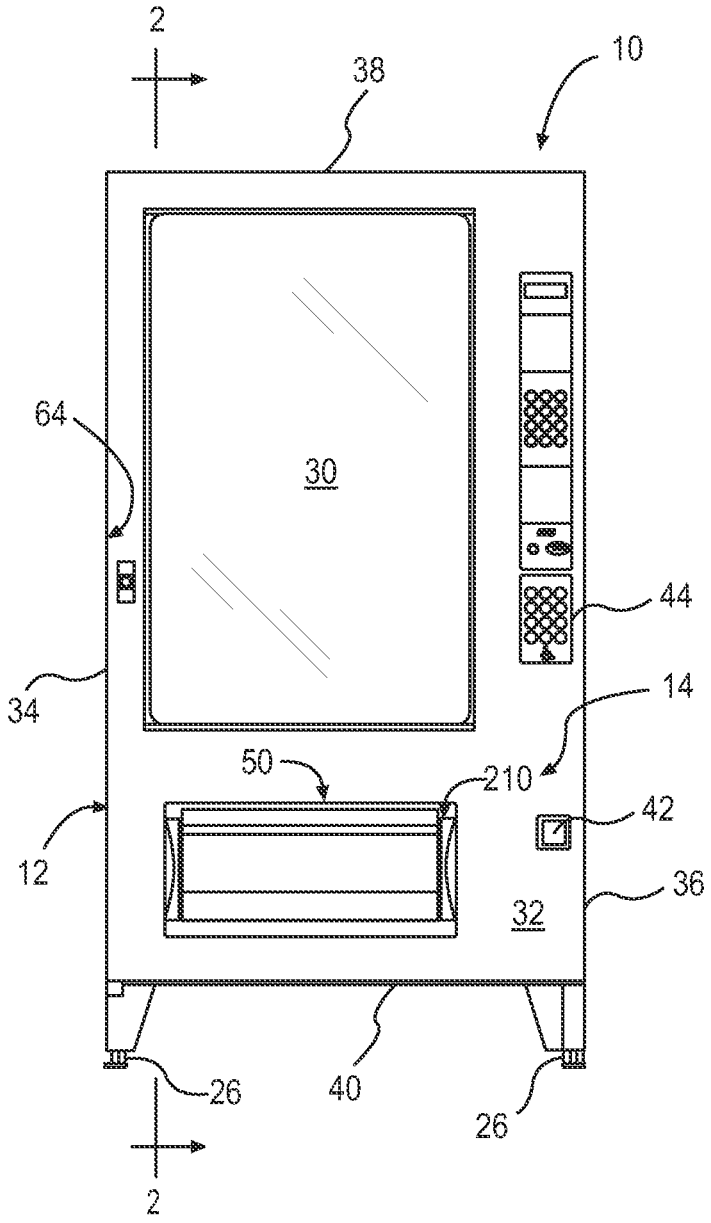
FIG. 1 is a front elevational view of the vending machine.

To gain a better understanding of the invention, a preferred embodiment will now be described in detail. Frequent reference will be made to the drawings, and reference numerals or letters will be used throughout to indicate certain parts or locations in the drawings. The same reference numerals or letters will be used to indicate the same parts and locations throughout the drawings, unless otherwise indicated.

B. Environment

The preferred embodiment now described will be with respect to a glass front vending machine. The scale of the embodiment, therefore, is to be understood with respect to this type of device or equipment. However, the present retrieval system could work for other vending machines, for example closed front vending equipment, so long as the path of travel of a vended product was directed into the hopper opening when the hopper is in its closed position. It is to be understood as well, however, that the invention is applicable to other articles and its scale can vary accordingly.

C. Structure

Figure 2:
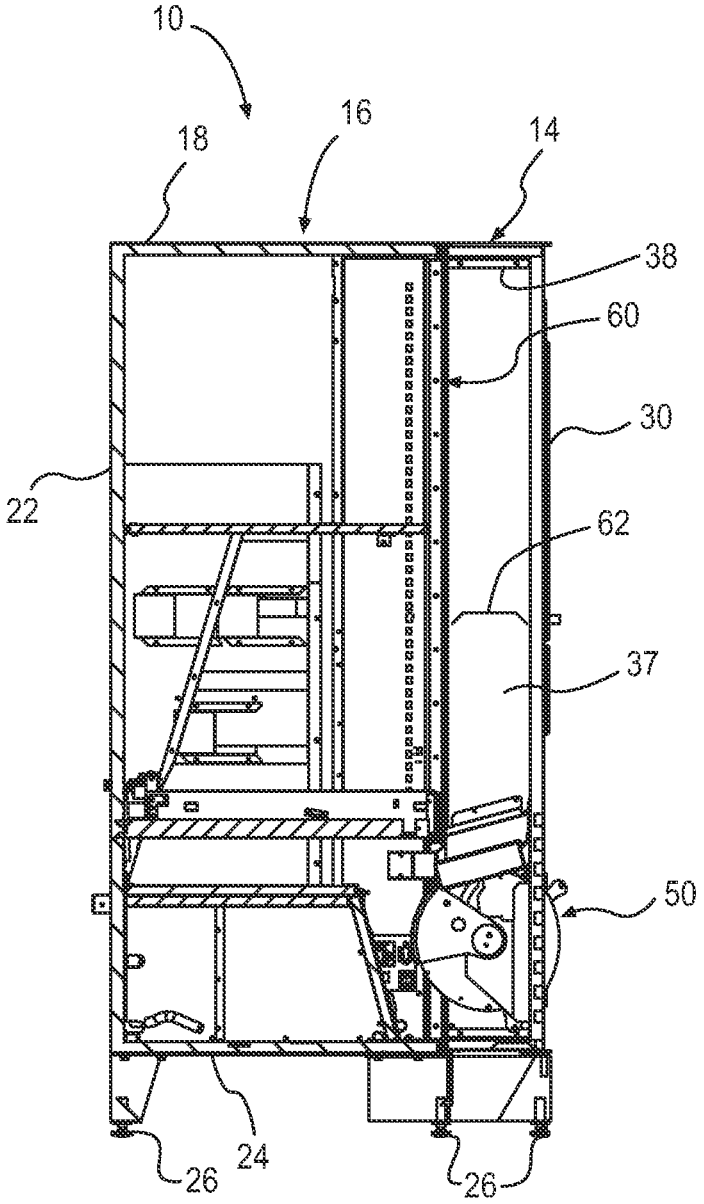
FIG. 2 is a cross-sectional view taken along line 2-2 in FIG. 1.

FIGS. 1 and 2 show such a glass front vending machine 10 as being comprised of an outer casing 12 comprised of a front door 14 that is hinged or otherwise attached to a rear portion 16 comprised of separate top wall, opposing side walls, and rear and bottom walls which are shown at 18-24, respectively, as well as a plurality of height adjustable feet 26. The front door 14 and the rear portion 16 collectively define the outer casing structure 12 for the vending machine.

Figure 8:
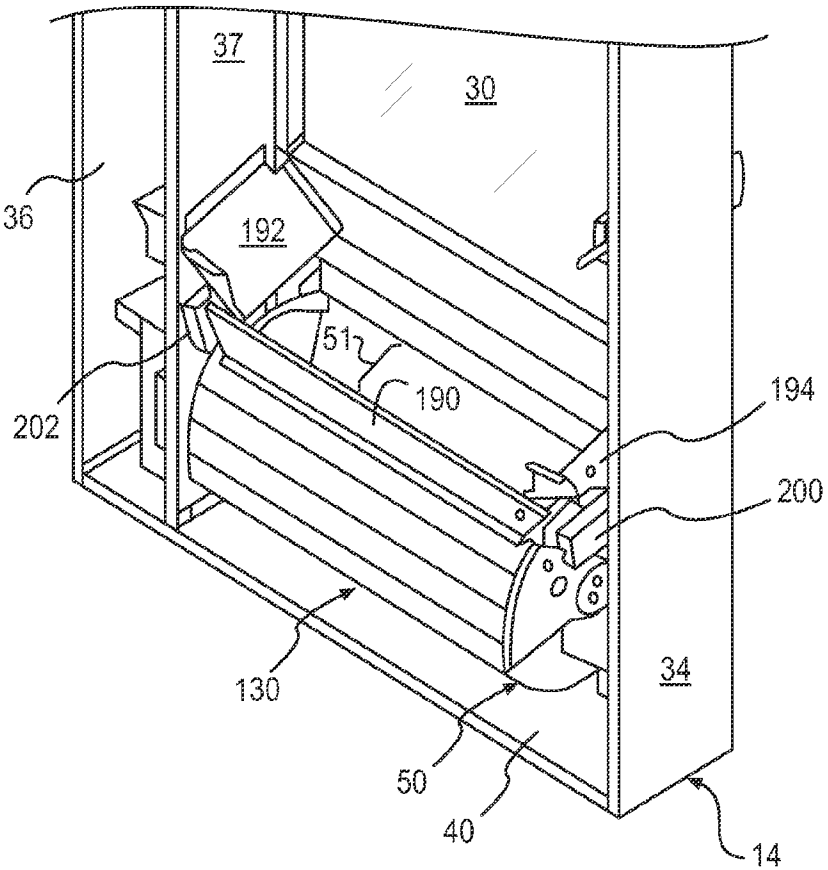
FIG. 8 shows a closed rotary retrieval bin mechanism from inside the door.

The front door 14 includes a glass front 30 that is retained in a front panel 32, as well as opposite sides 34 and 36, a top 38 and a bottom 40. Door 14 also includes a change return 42, a suitable control panel 44 and a retrieval mechanism 50. As shown in FIG. 8, an additional vertical interior wall 37 can be provided at a point spaced inwardly from side wall 36 with the space between walls 36 and 37 providing room to mount other parts of the vending machine such as, for example, electronics, the coin changer assembly, bill validator. The amount of spacing between walls 34 and 37 varies with the size and capacity of the vending machine 10 and therefore also affects the length of retrieval mechanism 50. Thus, a larger and higher capacity machine will require a longer rotary hopper 70 and thus the spacing between walls 34 and 37 might be greater.

Inside the vending machine 10 is a product holding section 60 that can include any form or grouping of known product dispensing assemblies, product holding and dispensing trays, or other product holding and dispensing devices as one might envision, which can be of varying types and/or configurations, limited only by the particular products one might choose to vend from each tray or device within the vending machine as a whole. Also included inside the vending machine is a vend space 62 that exists both vertically and horizontally, with the horizontal width being defined by the interior portions of the vertically extending side walls 34 and 37, and with a front-to-back depth defined between the front of the product holding section 60 and glass 30. A dispensed product will fall through this vend space and into the retrieval mechanism 50.

Figure 3:
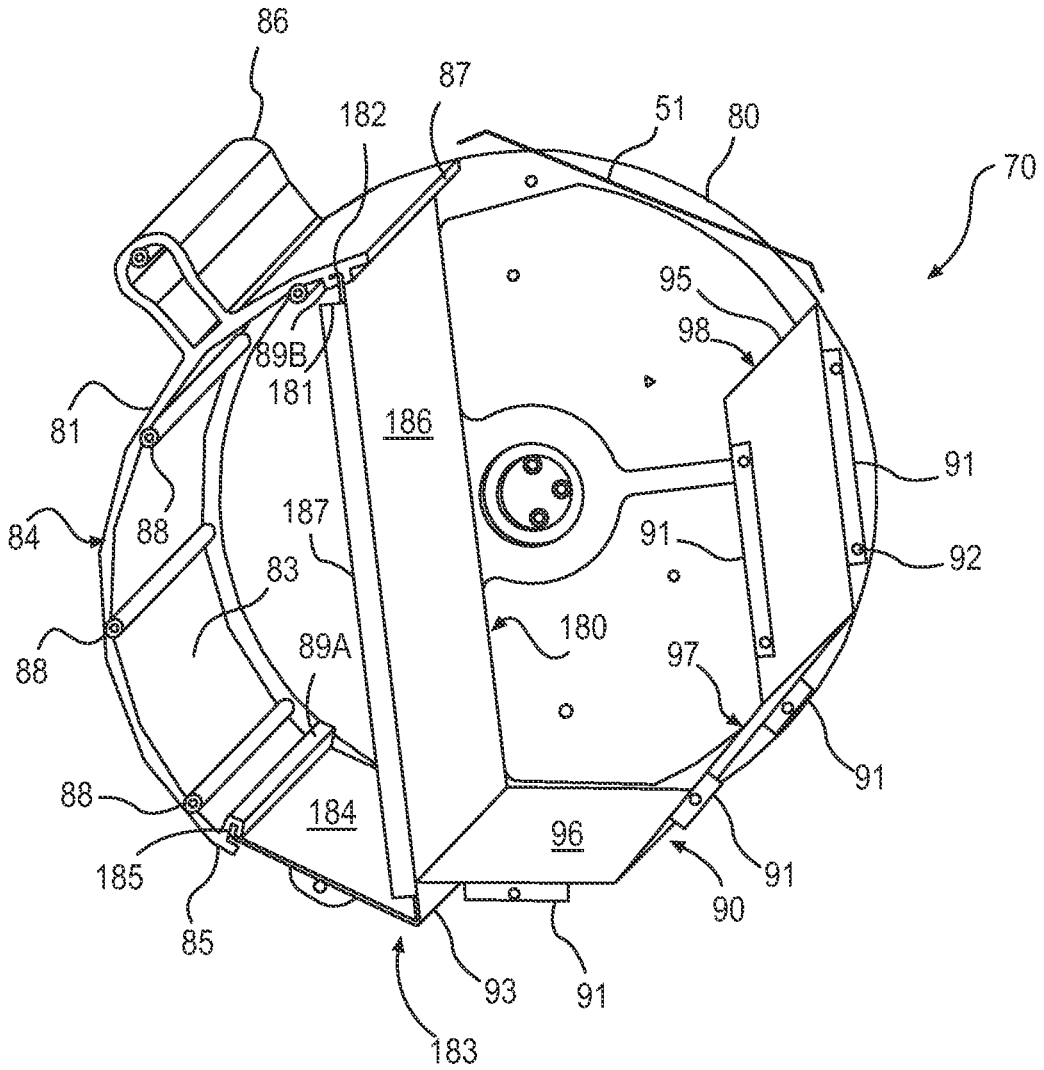
FIG. 3 is a cross sectional view through an assembled rotary hopper, with portions being cut away for clarity.
Figure 4:
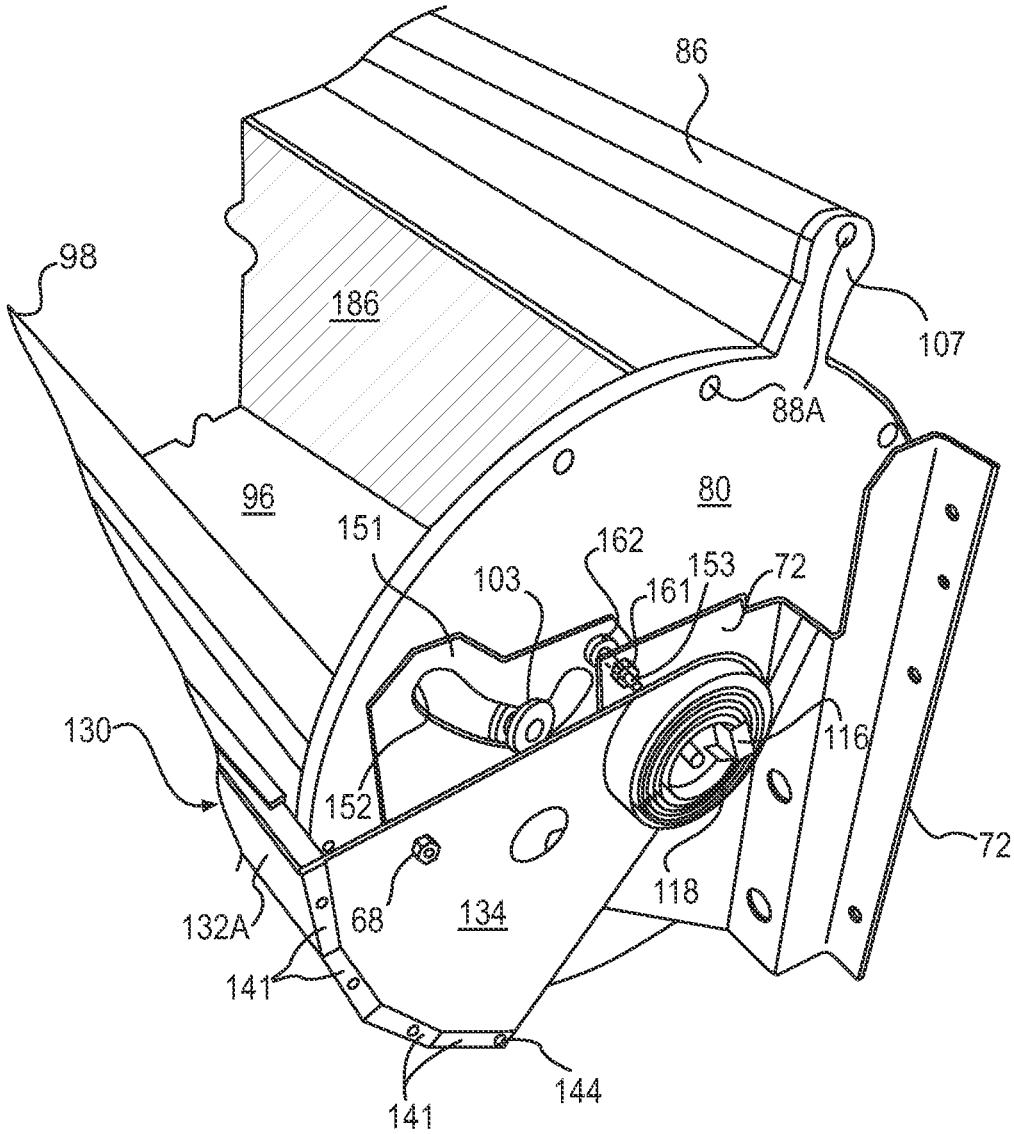
FIG. 4 is a perspective view of one end of the rotary hopper.
Figure 5:
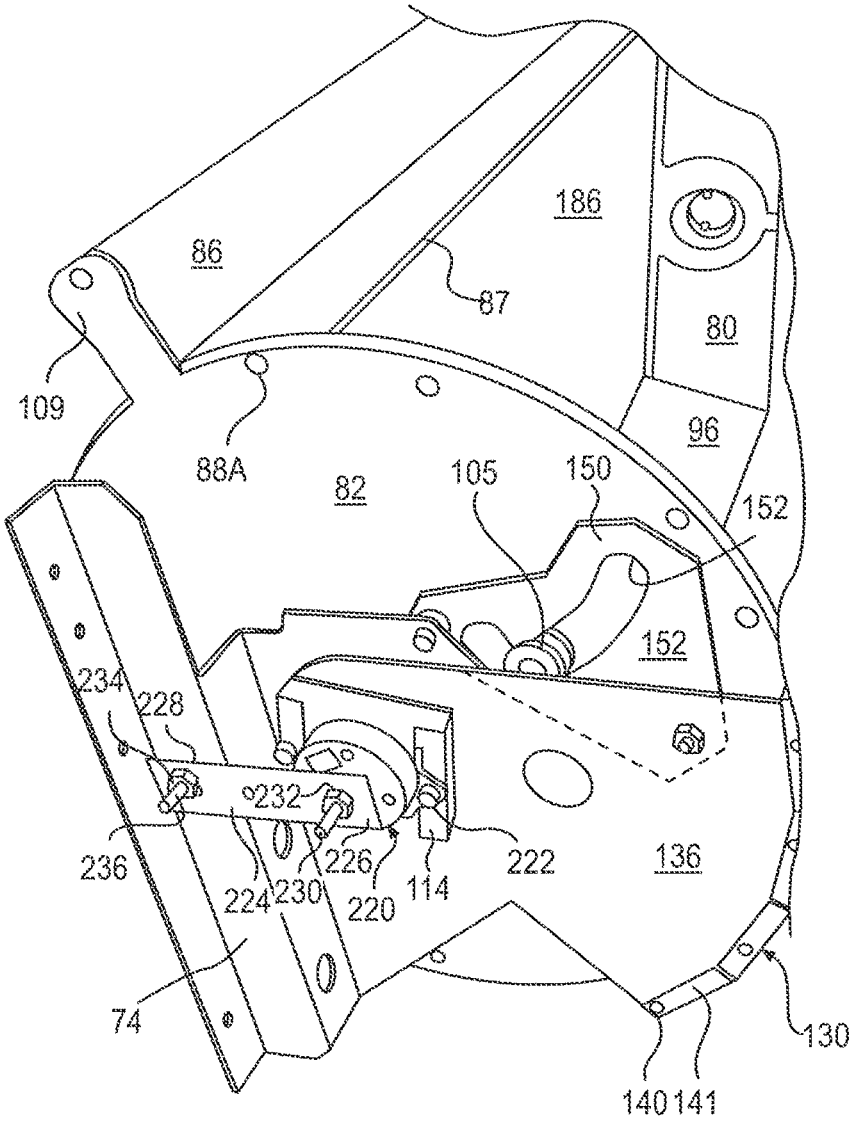
FIG. 5 is a perspective view of the opposite end of the rotary hopper.
Figure 7:
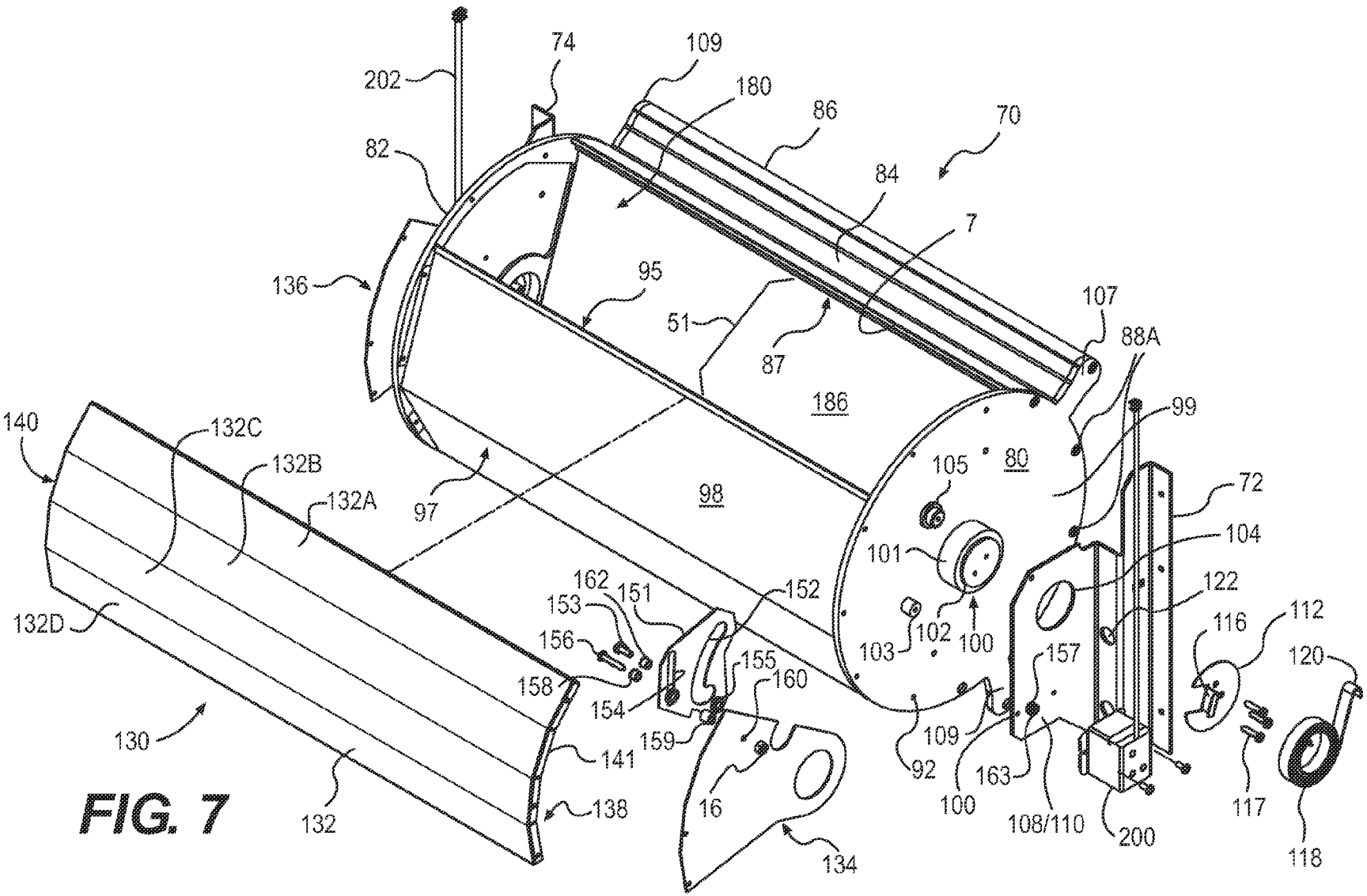
FIG. 7 is an exploded perspective view of the rotary retrieval bin mechanism.
Figure 12:
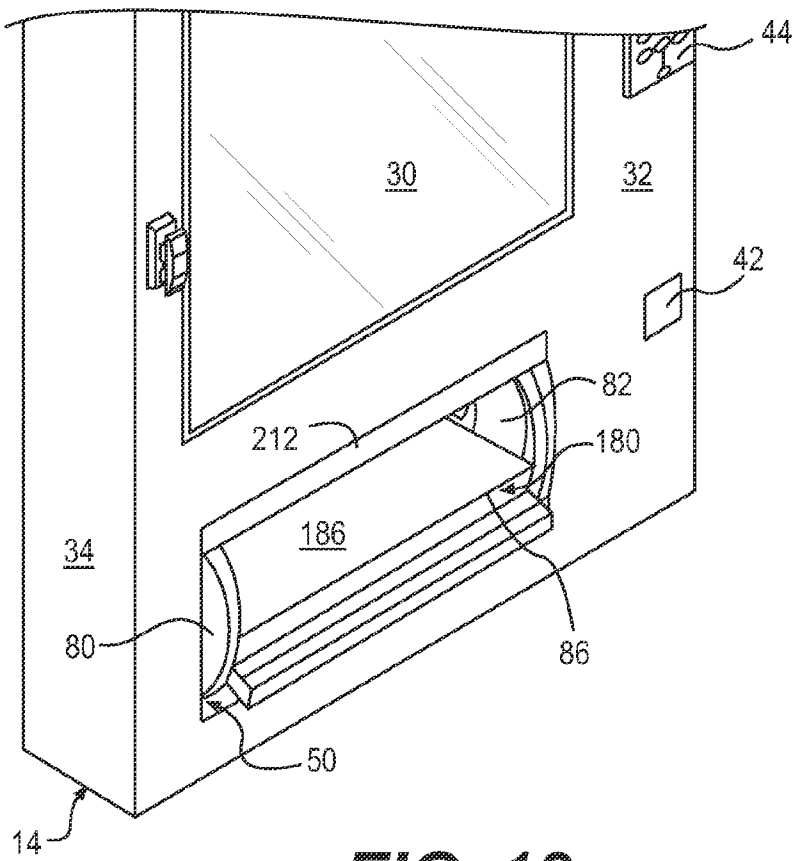
FIG. 12 shows an open rotary retrieval bin mechanism from outside the door.
Figure 13:
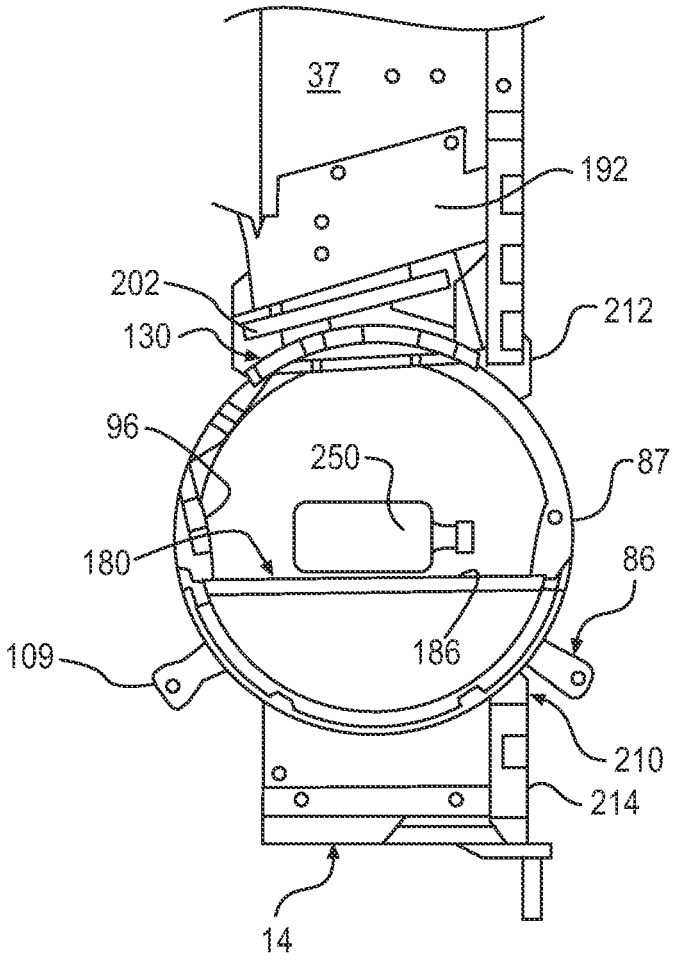
FIG. 13 shows a cross sectional view of the rotary retrieval bin mechanism in FIG. 11 and a portion of the door.
Figure 14:
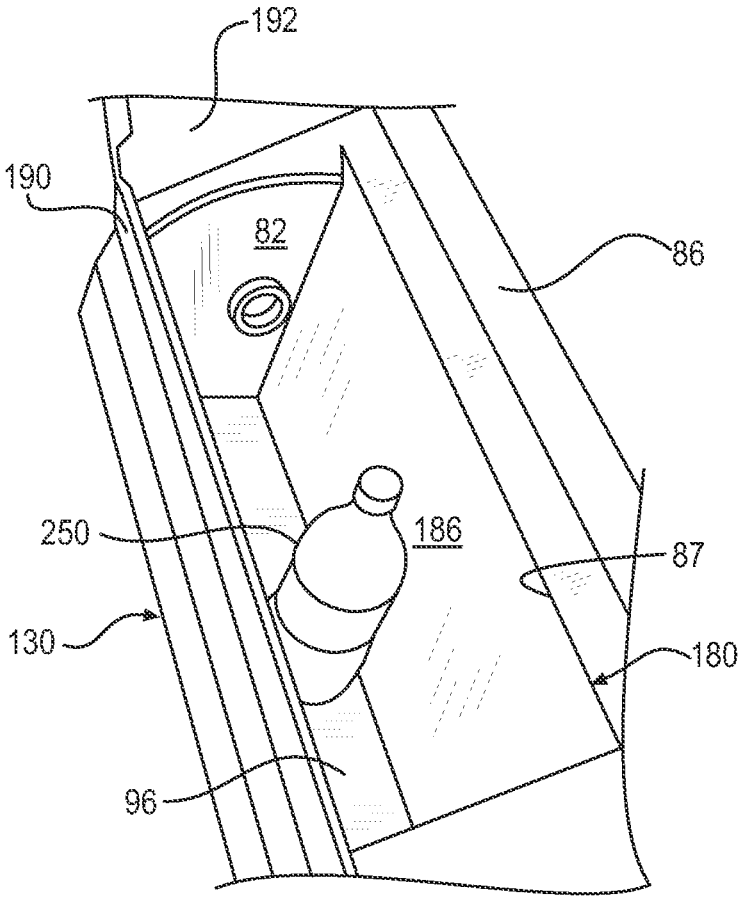
FIG. 14 shows the interior of the rotary retrieval bin mechanism.

The retrieval mechanism 50 is shown in an exploded form in FIG. 7 and its opposite sides are shown in FIGS. 4 and 5 so that the parts thereof can be described and their interaction better understood. The retrieval mechanism 50 is designed to not only rotate within door 14, but is formed primarily from a rotatably mounted, elongated, generally cylindrical hopper 70. As shown in cross section in FIG. 3 hopper 70 includes a large and deep interior space that will be capable of receiving a wide variety of product types and shapes, from small items, such as gum or candy bars, to large drink bottles, for example, as shown in FIG. 14, even when received therein on their bottom ends. The retrieval mechanism 50 is designed to rotate between closed and open positions or conditions. In the closed condition the retrieval mechanism 50 will have an opening 51 aligned with and located at the bottom of the vend space 62, as in FIG. 8, so that a dispensed product can fall or drop into the cylindrical hopper 70 and will come to a stop on the actual floor or bottom 96 of rotary hopper 70. At the same time, a false bottom 180, positioned at an angle when hopper 70 is in its closed condition and extends vertically across a portion of the hopper's interior adjacent the area into which a product will drop and across the whole width of hopper 70. False bottom 180 is positioned in a way that will not affect the interior depth of the hopper 70 that is aligned with the vend space 62 and will not prohibit a vended product from contacting the actual floor 96, but rather may act as a guide to floor 96. The false bottom 180 will itself produce a technical floor or bottom for hopper 70, once hopper 70 is rotated into its open condition, as in FIGS. 12 and 13, with that technical floor being higher than the location of actual floor 96 of hopper 70 in its closed condition. Thus, the technical floor created by the false bottom 180, when the retrieval mechanism 50 is rotated into its open condition, will become the support for the dispensed product and due to its position in hopper 70 the product will be raised upwardly to a higher point for collection that will comply with 2010 ADA requirements as well as making collection easier due to the raised height. This raised delivery position is thus accomplished without the need for a corresponding height change to the position of the lowest product dispensing assembly, shown as 60A in FIG. 2, and the full vending capacity of the machine is retained.

The retrieval mechanism 50 is designed to rotate within an opening 210 provided in front door 14 and is therefore rotationally mounted within door 14 to accomplish that result. Retrieval mechanism 50 also includes a security shield 130 that will be moved into place in advance of the rotary hopper 70 getting to its full open position to close the opening into the vend space 62 from within hopper 70 and to thereby prevent tampering with product retained on trays in the product holding section 60 of vending machine when rotary hopper 70 is in its open condition.

Rotary hopper 70 is mounted to the inside of door 14 by a pair of mounting brackets 72 and 74, positioned at opposite ends thereof, that rotatably support the opposite ends of rotary hopper 70 to the inside of front door 14. The structure of retrieval mechanism 50, and in particular rotary hopper 70, can begin with two end caps or plates 80 and 82, which are each connected to opposite sides of an elongated, semi-circular extrusion 84 that forms part of the outer shell of rotary hopper 70. The curved outer surface 81 of extrusion 84 also forms the curved front wall of the retrieval mechanism 50, which will close vending opening 210 in door 14 and be visible from the outside of the vending machine, as well as a curved interior surface 83 which forms part of the interior of rotary hopper 70.

Extrusion 84 also includes a front handle structure 86 that preferably extends along the full length of rotary hopper 70. That length for handle 86 while preferable is not necessary since a handle of a shorter length or having a different design will also function to permit one to rotate the retrieval mechanism 50 from it's closed to its open position.

As noted above the extrusion 84 has the form of an elongated semi-circular structure. However, it should be understood that in addition to being an extruded part this structure 84 could also be formed as integrally molded part. Extrusion 84 also includes various connection points 88 at each end for both of the end caps 80/82 at spaced apart locations along the outer edge. Also, two open channel structures are provided within the extrusion which extend along the length thereof for permitting the connection to the false bottom 180, two of which are shown at 89A and 89B. Consequently, extrusion 84 is preferably a one-piece plastic structure that can be formed from any extrudable or moldable material including plastics, thermoplastics, polyvinylchloride, polycarbonates or from composite materials or reinforced materials. Extrusion 84 also includes a bottom rear edge 85 and a top front edge 87. Extrusion 84 preferably has a length of about 20.25 inches, a radius of about 5.7 inches and a thickness of about 0.188 inches, but these and all of the dimensions set forth herein are exemplary.

One of the two end caps, 80 and 82, is mounted to each of the opposite end of extrusion 84, respectively, by screws 88A, or be otherwise secured thereto by heat welding, by adhesives or by another convenient mounting approach, so that when connected together end caps 80 and 82 and extrusion 84, collectively, form a relatively unitary and stable structure. The end caps 80/82 are preferably molded from ABS plastic, but other moldable materials as indicated previously could also be used.

Figure 10:
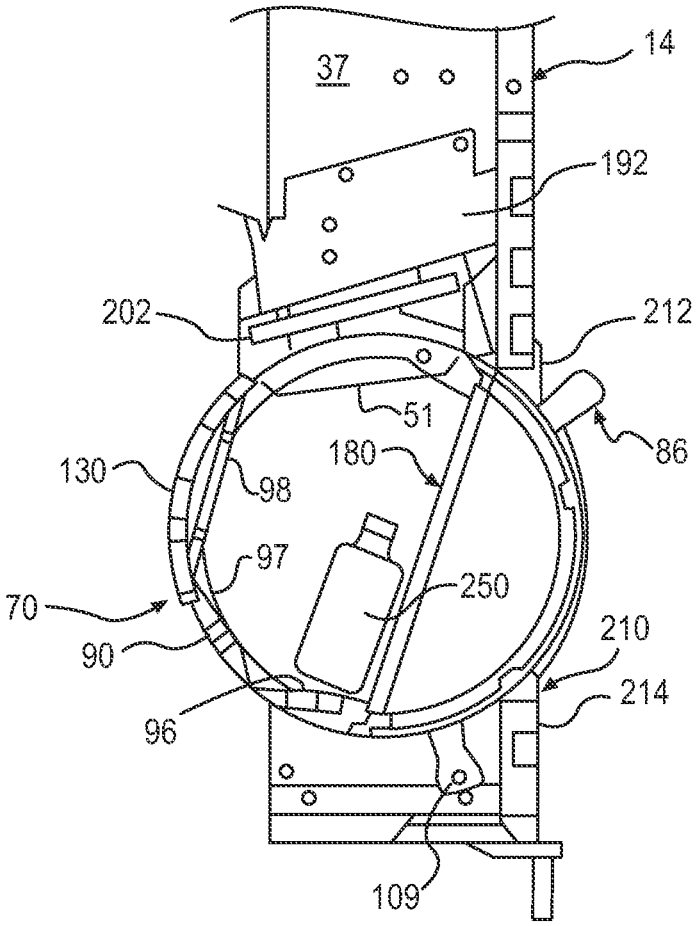
FIG. 10 shows a cross sectional view of the rotary retrieval bin mechanism shown in FIG. 6 and a portion of the door.

Each end plate 80/82 includes a centrally positioned hub 100 formed on an outer surface 99 (for example as shown in FIG. 7) having two stepped portions, in the form of a base 101 and a raised, smaller diameter portion 102 that will be used in mounting the rotary hopper 70 to mounting brackets 72/74 and for mounting other components to the retrieval mechanism 50. In addition, as shown in FIGS. and 7, there is a bearing post 103 and a bearing 105 that extend outwardly from surface 99 as well as two shaped radially extending formations 107 and 109 shaped to correspond to the end shape or profile of handle 86 and which are spaced about 130° apart around the outer circumference of each end cap 80/82. In fact, each end plate 80/82 is identically formed so that each can be used on opposite ends by simply turning one around to then fit at the opposite end. Thus, as shown in FIGS. 10 and 13 one can see one of the radial formations 107/109 that lies within the door 14 and is otherwise unused. Likewise, when used on one side bearing 105 will be used with a corresponding linkage structure 134 while when turned round for use on the opposite end bearing 105 will be used together with linkage 136 at that opposite end, but more on that later in this specification.

The next portion of the outer shell of rotary hopper 70 that can be attached to end caps 80/82 is the false bottom 180 that will span across the two ends 85 and 87 in a diagonal manner as shown in FIGS. 3 and 10. False bottom 180 includes one end 181 having a hook 182 formed thereon. An opposite end 183 is formed with an angled plate 184 positioned at a angle of about 58° relative to the main planar body 186 thereof and a hook 185 is formed at the outer end of plate 184. The planar body 186 can be a flat plate or it can be formed to have another desirable shape or configuration. Planar body 186 could also be formed with folded over edges 187 to increase its flex strength. False bottom 180 is preferably constructed from 22 gauge galvanized steel, but other materials could be used as well or it could also be a molded structure, as part of extrusion 84.

As noted previously, the extrusion 84 includes two elongated channel structures 89*a* and 89*b* that extend along the length of the extrusion adjacent ends 85 and 87, respectively. Channel 89*b*, adjacent end 87 of extrusion 84, can receive hook 182, for example by having hook 182 slide into and along the length of the channel 89*b*. At the opposite end of false bottom 180, adjacent end 85 of extrusion 84, the hook 185 can be slidingly received within and along the length of channel structure 89*a*. When so installed the angled plate 184 will also form a portion of the outer shell of rotary hopper 70 as well as providing part of the connecting link to extrusion 84. As an example of the relative dimensions of false bottom 180, the angled plate 184 can have a width of about 3.5 inches which will provide a radial distance between false bottom 180 and the maximum point of the curve of extrusion 84 of about 4.7 inches. Also, planar body 186 can have a length of about 20.25 inches and a width of about 4 inches.

The last portion or segment of the outer shell of rotary hopper 70 is a rear panel 90, preferably formed as a segmented or curved member that is also shaped to be complementary to the curved shape of extrusion 84 and to the outer peripheral shape of end caps 80/82. Rear panel 90 is also mounted between end caps 80/82 in a way that will continue the curved interior and exterior of rotary hopper 70, since it will complete the formation of the interior portion of hopper 70 in which product dispensed from a product holding tray is initially received. An outer edge thereof 95 will also help define, along with edge 87, the opening 51 into the interior of rotary hopper 70. Rear panel 90 extends from its own interior bottom edge 93 that will be attached to false bottom 180 and be positioned at the bottom of the rotary hopper 70. Rear panel 90 then extends around to its own top edge 95 through successive panel sections or segments 97 and 98. Rear panel 90 can be mounted or attached to end caps 80/82 by screws 92 that could extend through tabs 91 formed along at least portions of the sides of each of three segments 96, 97 and 98 that collectively define rear panel 90. It should also be understood that rear panel 90 could be secured to end caps 80/82 by other mechanical devices, such as rivets, by adhesives, or by another approach that will securely connect those pieces together into a strong, unitary structure.

Rear panel 90 could also be form as a one-piece structure, for example it could be molded or extruded from materials like those mentioned above for extrusion 84 or be otherwise formed from plastic, reinforced plastic, from metal or from a composite formed from a variety of manmade materials.

Preferably, rear panel 90 will be formed from metal, such as 24 gauge steel, and be shaped into successive segments created within a sheet of metal by making a series of length wise creases in the metal sheet at spaced apart intervals and specifically at three points to form the three segments 96, 97 and 98, respectively. Those segments can then be bent and collectively formed into a curve like shape. For example, the rear panel 90 could have a length of about 20.25 inches and segment 96 could have a width of 3.34 inches, segment 97 could have a width of about 3.9 inches and segment 98 could have a width of about 5 inches, respectively. These segments could then be bent so that an angle of about 134 degrees is formed between segments 98 and 97, while an angle of about 120 degrees can be formed between segments 97 and 96. Tabs 91 can be formed along a portion of each side edge of panels 96-98 and provide a mechanism for attaching the rear panel 90 to end caps 80/82.

As shown in FIGS. 3, 4, 7, 10, when the extrusion 84, the false bottom 180 and the rear panel 90 are collectively secured to end caps 80/82 an elongated rectangular opening 51 will be defined by the elongated edge 87 of extrusion 84, by the top edge 95 of the rear panel 90 and by the two opposing end caps 80/82.

The rotary hopper 70 also includes a separate security door 130 to assure that opening 51 is closed at all times during which the rotary hopper 70 is in its opened condition. As is explained before, it is desirable that the linkage assembly controlling movement of security floor 130 move—very quickly into its closed security position as rotary hopper 70 is being opened and preferably at an early point in that opening sequence to prevent someone from reaching or 'fishing' through any partial opening.

Security door 130 can be comprised of a one piece molded structure or preferably formed as a multi-segmented structure, including panels 132A-132D, from 24 gauge steel. Mounting brackets 134/136, preferably formed or stamped from 16 gauge galvanized steel, will be used at each of the opposing ends 138 and 140 of security door 130 and separate linkage members 150 and 151, also formed or stamped from 16 gauge galvanized steel, will be mounted outside of end caps 80/82 as well as on to and between the hopper mounting brackets 72/74 and the mounting brackets 134/136, respectively.

Security door 130 also includes folded over tabs 141 at each end of segments 132A-132D so that those tabs 141 can be attached over an outer edge 142 of mounting brackets 134 and 136 by screws 144 that fit into apertures 143. Thus, security door mounting brackets 134 and 136 will be mounted at each of the opposing ends 138 and 140, respectively. Security door mounting brackets 134/136 also each include an aperture 170/171 that will permit the security door 130 to be mounted in place on the rotary hopper 70. The overall length of security door 130 is formed to be slightly longer than the length of rotary hopper 70, as it is mounted over a portion of hopper 70, and will preferably have an outer length of about 22.50 inches so that it and its mounting brackets 134/136 overlie the exterior of end caps 80/82. Each of the outer segments, 132A and 132D can have a width of about 1.79 inches while the two inner segments, 132B and 132C, can have a width of 1.784 inches. Preferably, each of these segments can be formed by creasing a flat sheet of metal at three spaced locations and then bending each segment, relative to adjacent segments, each segment being at an angle of about 17° to adjacent segments, which then forms the curved shape for the security door 130.

Linkage members 150 and 151, with one being used at each end, are provided with two interior slots 152 and 154. Slot 152 has a generally "J" shaped form while slot 154 has a substantially straight, uniformly wide and vertically extending form.

Linkages 150 and 151 will be connected to and between both the mounting brackets 72/74 and to mounting brackets 134 and 136. First, linkage 150/151 will be connected to mounting brackets 134/136, respectively, by a screw 156 that extends through a short bearing 158 designed to fit into and slide within slot 154 with screw 156 then extending through a spacer 159 and will be attached to mounting brackets 134/136 through a threaded aperture 160 therein and is retained in place by way of a self-locking nut 161. Spacer 159 creates a gap between linkages 150 and 151 and each of the respective mounting brackets 134 and 136.

Linkages 150/151 are also attached to mounting brackets 72/74 by another screw 153 that fits through a hole 155 provided in linkages 150/151 and located near a corner that is adjacent the bottom of the J-slot 152 and screw 153 will then pass through a hole 157, provided in mounting brackets 72/74 adjacent a corner thereof that is located below apertures 104/106, and is secured in place by nut 163. A spacer 162 is mounted over screw 153 and is positioned between linkages 150/151 and mounting brackets 72/74 with screw 153 then retained within mounting brackets 72/74 by a self-locking nut 163. When so mounted linkages 150/151 can rotate relative to both sets of mounting brackets 134/136 and 72/74 at their respective ends of the retrieval bin mechanism 50.

Figure 6:
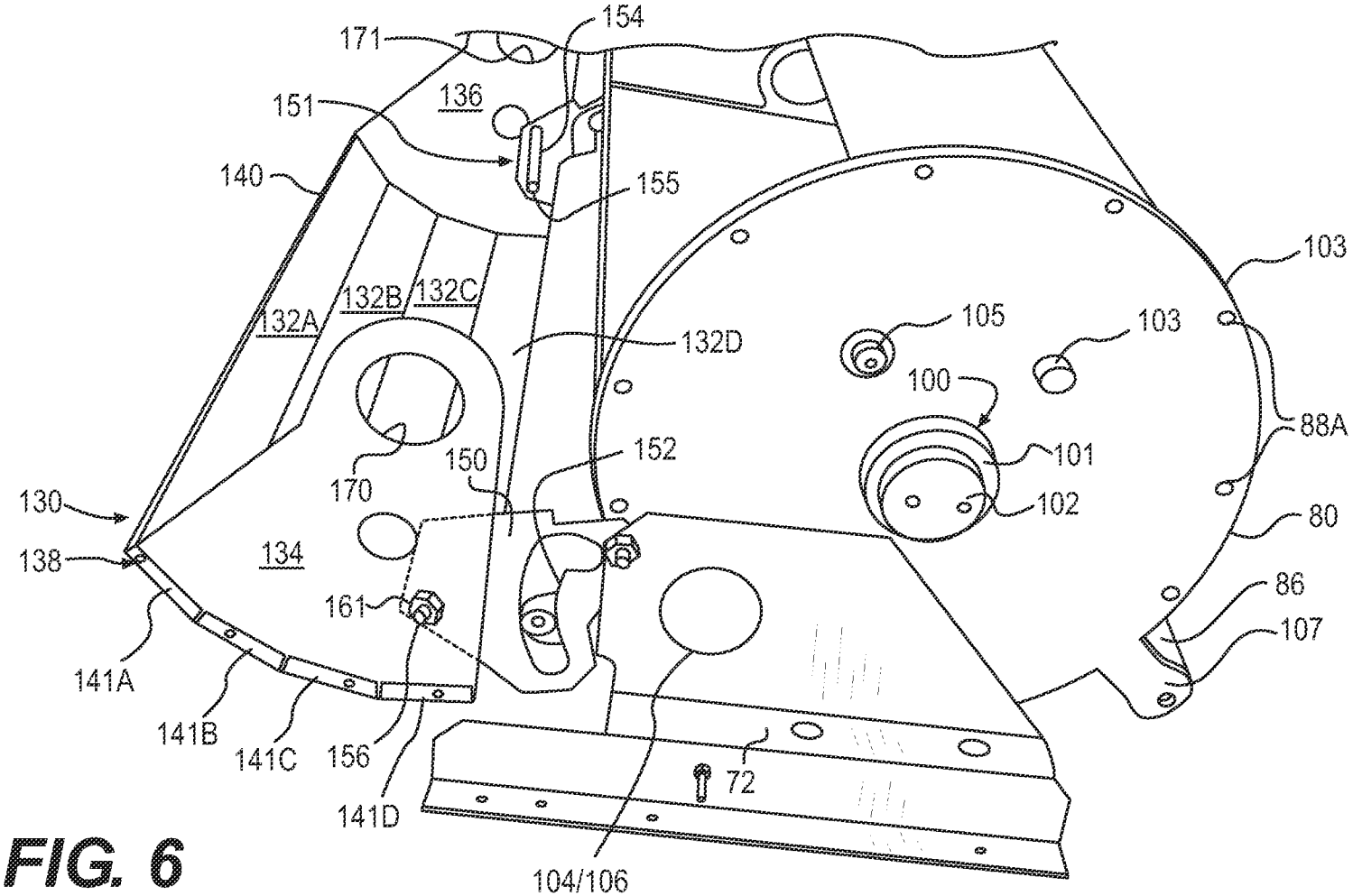
FIG. 6 is a perspective view of a partially assembled structure at one end of the rotary hopper.

With reference to FIGS. 6 and 7, end caps 80 and 82 each includes an outwardly extending hub or spacer 100 comprised of a two-step structure with a first portion 101 having a larger diameter of about 2.25 inches with an exteriorly positioned next step 102 having a smaller diameter of about 1.74 inches. The end of hub 100 also includes screw holes that will be used during assembly of the hopper 70 to mounting brackets 72/74 and in mounting security door 130.

Each mounting bracket 72/74 includes an aperture 104/106 positioned in a central portion of an extension 108/110 of mounting brackets 72/74, respectively, that will during assembly fit over and receive the smaller diameter stepped portion 102 therein and thus rotatably support the hopper 70 thereby.

The assembly process for the retrieval mechanism 50 can begin by connecting together the end caps 80/82 to the extrusion 84, the false bottom 180 and the rear panel 90 as has been described herein above. Then, following the assembly of security door 130 to brackets 134/136 and the interconnection between linkage 150/151 and the two sets of mounting brackets 134/136 and 72/74, the security door 130 is mounted in place using mounting brackets 134/136, linkages 150/151 and mounting brackets 72/74 can then be attached to the interior of door 14.

To mount security door 130, both sets of mounting brackets 134/136 and 72/74 can be rotated from the position shown in FIG. 6 so that apertures 104/106 and 170/171 are in axial alignment for mounting onto the rotary hopper 70 and specifically onto hub 100 of the two end caps 80/82. This will also be along the center axis of apertures 104/106 and 170/171 in alignment with the central rotational axis of rotary hopper 70. Then, aperture 104/106 of mounting brackets 72/74, respectively, will be slid onto hub portion 102 followed by sliding apertures 170/171 of mounting plates 134/136 over the same hub portion 102.

Once each of the pairs of apertures 104/106 and 170/171 of mounting brackets 72/74 and 134/136, respectively, have been placed on each of the hub portions 102 of end caps 80 and 82, respectively, an end cap washer 112/114 at opposite ends, respectively, will then be used to hold each of the mounting brackets 72/74 and 134/136 onto each of the hubs 100 on each end cap 80 and 82. End cap washers 112/114, respectively, will be suitably attached to end caps 80/82 and to the respective hub 100 by screws 117 which will rotatably secure the retrieval mechanism 50 to the mounting brackets 72/74 and the security door 130 to each of the mounting brackets 72/74 and to rotary hopper 70. This will establish a rotatable connection between rotary hopper 70 and mounting brackets 72/74 as well as a rotational connection between security door 130 and both the rotary hopper 70 and the mounting brackets 72/74. Movement of security door 130 relative to the rotary movement of hopper 70 will be controlled by linkages 150/151.

Washer 112, which lies adjacent end cap 80, includes a shaped hook type flange 116 under which a spiral torsion spring 118 will be mounted on that side of rotary hopper 70. Spring 118 includes a hooked end 120 that will be inserted into a slot or opening 122 provided on mounting bracket 72. This mounting for spring 118 will be such that as the rotary hopper 70 is rotated from a closed condition to an open condition by pulling down on handle 86, spring 118 will be wound sufficiently to provide a closing rotational force to assist in the re-rotation of the rotary hopper 70 from the now open condition back to its closed condition. Alternatively, spring 118 may be provided with enough spring force to fully and automatically return hopper 70 to its closed position once handle 86 is released.

On the other end of hopper 70, adjacent end cap 82, end cap washer 114 has a damper mechanism 220 secured thereto by screws or rivets 222 and a connection bar 224 that has one end 226 connected at the center of damper mechanism 220 by a screw 230 and a nut 232 and an opposite end 228 fixed to mounting bracket 74 by a nut 234 mounted on a screw 236 fixed to bracket 74. As connected, when rotary hopper 70 is rotated from its closed condition to its open condition damper mechanism 220 will be loaded to provide a damping force or resistance so that when handle 86 is released and spring 118 returns the rotating hopper 70 toward its closed condition damper mechanism 220 will dampen or slow the return rotation so that the rotation is not too fast or sudden to assure that a purchasers hand or fingers are not caught or pinched by the closing action of hopper 70 and handle 86.

When this assembly process is complete, this arrangement places the central axis of apertures 170/171 in axial alignment with apertures 104/106 in the mounting plates 72/74 as well as with hubs 100, washer end caps 112/114 and most importantly with a central rotational axis of rotary hopper 70 itself. Once the retrieval mechanism 50 is fully assembled mounting brackets 72/74 will each be secured onto the inside of front door 14 by screws or other suitable connectors that will assure a fixed and secure connection there between.

The rear panel 90 has a top edge 95 and a bottom edge 93 while extrusion 84 has a top edge 87 and a bottom edge 85. Top edges 87 and 95 along with end caps 80/82 define the opening 51 into hopper 70 through which falling dispensed products will pass as they enter the interior of hopper 70. The false bottom assembly 180 is mounted within rotary hopper 70 provides the mechanism that will permit dispensed products to both be received through opening 51 and into the interior of the rotary hopper 70, any size dispensed product, even tall or long products to be effectively raised to a higher collection level.

Figure 9:
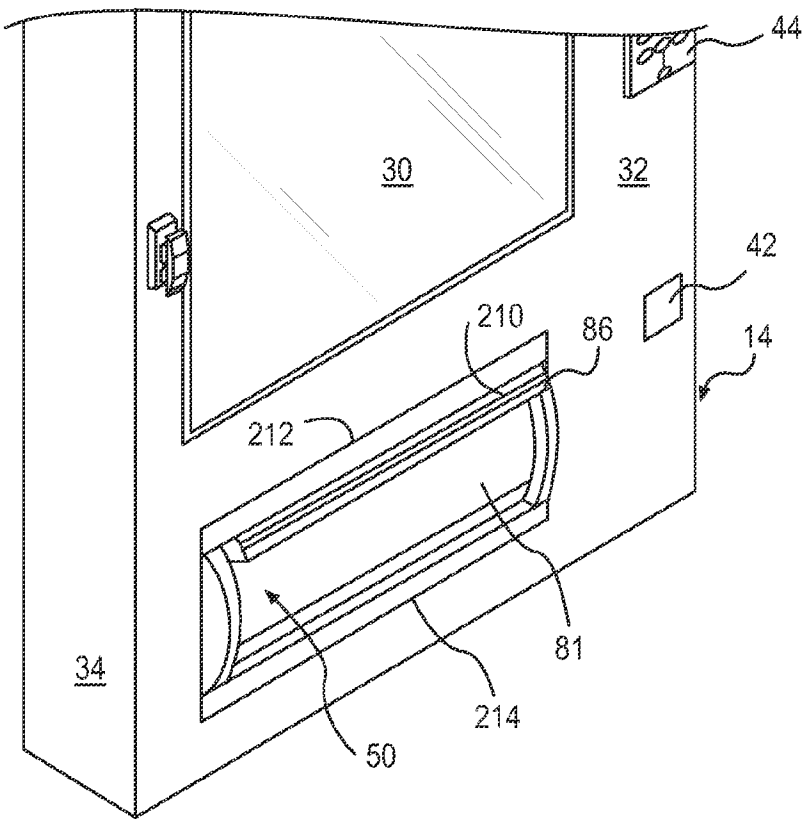
FIG. 9 shows a closed rotary retrieval bin mechanism from outside the door.

As shown in FIGS. 3, 7, 8, 10 false bottom assembly 180 is preferably positioned at a angle relative to opening 51 when hopper 70 is in its closed condition. False bottom assembly 180 spans across the inside of extrusion 84 between the rear bottom edge 85 and top edge 87 to thereby expose segment 96 as being the actual bottom surface of hopper 70 when in its closed condition and on which dispensed products will fall. Consequently, as shown in FIG. 8-10 with the rotary hopper 70 in its closed condition opening 51 defines the opening into rotary hopper 70 through which a dispensed product may fall into the retrieval mechanism 50 onto segment or actual bottom 96. To protect edge 95 an elongated deflector 190 is provided along the length of the space above the rotary hopper 70. To shield the end caps 80/82 two side mounted deflectors 192 and 194 can also be mounted to the inside of walls 37 and 34, respectively. This collective deflector assembly, comprised of members 190, 192 and 194 will be spaced above the retrieval mechanism 50 leaving a horizontally extending gap there between.

FIGS. 8, 10 and 13 also show a box 200 mounted to the inside of wall 34 and another box 202 mounted on wall 37 adjacent the gap mentioned above in the area above the retrieval mechanism 50 and below the deflectors 190-194. Box 200 is part of a Sensit® sensing system and will house detectors & emitters. Box 202 houses a set of emitters & detectors and both collectively, along with suitable control equipment comprise a product vend detection system for the vending equipment. The Sensit® can be better understood by reference to U.S. Pat. No. 6,384,402, which is hereby incorporated herein by reference thereto. By positioning boxes 200 and 202 as described a sensing plane of radiation will be generated to extend and operate across the length and width of the vend space and within the gap between the top of the retrieval mechanism 50 and the bottom edges of deflectors 190-194 to sense the vending of a product.

FIGS. 9 and 10 also show the closed condition of retrieval mechanism 50 and that a portion of the outer structure of hopper 70, for example, the front surface of extrusion 84, is in a position to close a product retrieval opening 210 formed within the front door 14 and with handle 86 lying adjacent the upper edge 212. The product retrieval opening 210 also is defined by a lower edge 214.

The hopper opening 51, shown in FIGS. 8 and 10, will be aligned with the vend space 62 so that a vended product, for example a bottle 250 as in FIGS. 10 and 14 will fall into the interior of hopper 70 and come to rest on segment 96 which is the actual bottom of the hopper's interior. It should be understood that the hopper's cross-sectional dimension is at its greatest cross-wise dimension and will be capable of receiving a wide variety of products. The surface 186 of the false bottom assembly 180 can also assist in guiding a dispensed product into the hopper and onto actual floor or segment 96.

Figure 15:
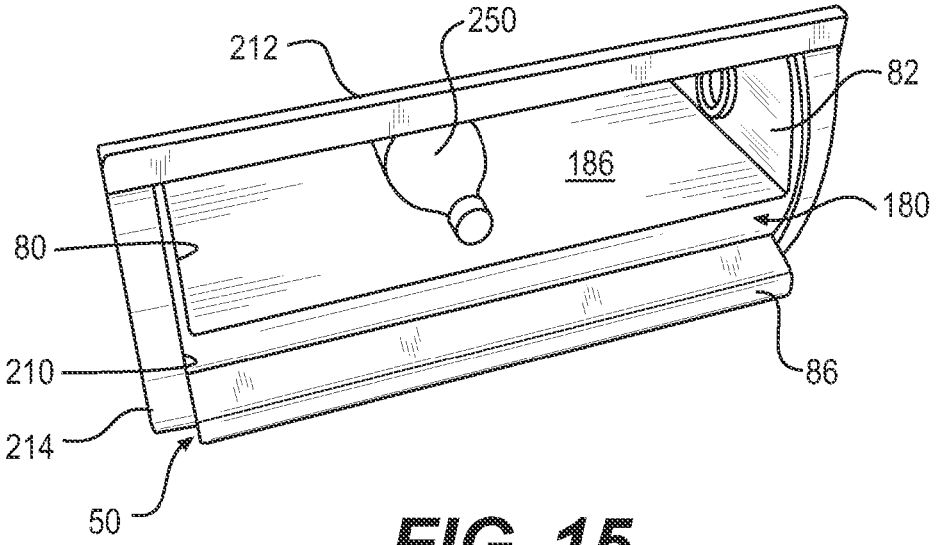
FIG. 15 shows an exterior view of a fully open rotary retrieval bin mechanism.

FIGS. 11-13, 15 and 16 show hopper 70 in the open position where handle 86 has been pulled downwardly causing hopper 70 to rotate until handle 86 abuts lower edge 214 of the product retrieval opening 210. The amount of rotation can, for example, depend upon the size of the hopper 70, the size of the product retrieval opening 210 and perhaps the type of product being vended. When fully open the hopper opening 51 will be aligned with product retrieval opening 210 and the dispensed product, bottle 250, will now rest upon the false bottom 180 as shown in FIGS. 13 and 15. In that condition the product being vended will be at a level that is higher than the level defined by segment 96 or the actual bottom of hopper 70. The amount of height increase will depend upon the distance between the outer shell of hopper 70 and the location of false bottom assembly 180 and surface 186. In the example being described here, as previously noted, there is a radial distance of about 4.7 inches between surface 186 of false bottom 180 and the maximum point of the curve of extension 84. Consequently, bottle 250 will be raised about 5 inches as the support for bottle 250 changes from being on the actual bottom 96 to when it is supported by surface 186 which occurs as hopper 70 is rotated from its closed to its open position thus presenting bottle 250 at a higher point for collection.

Figure 11:
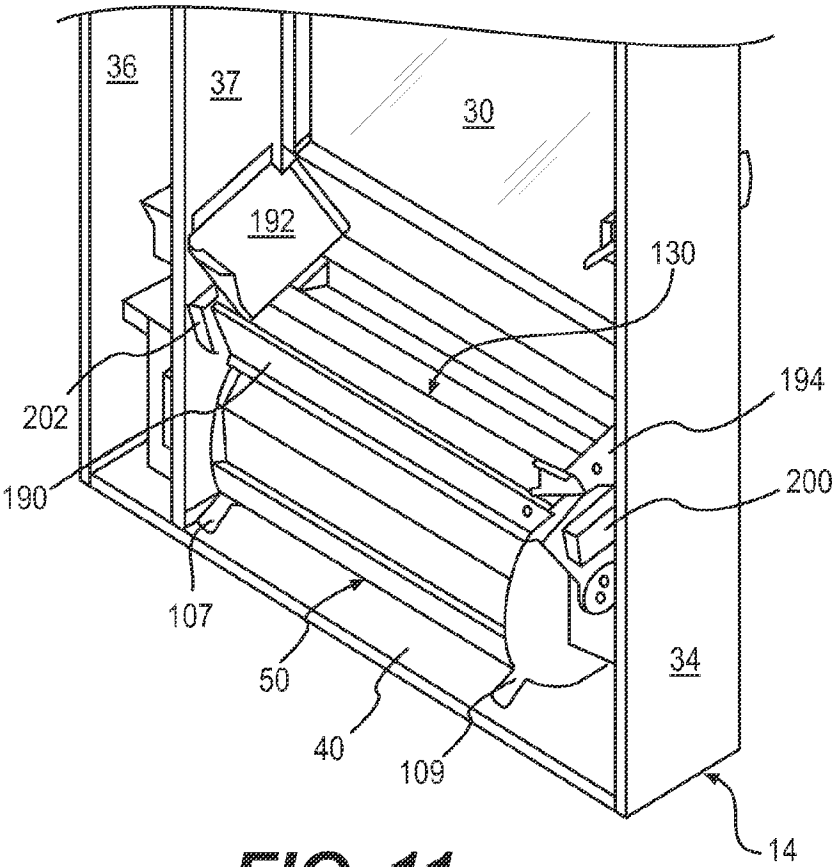
FIG. 11 shows an open rotary retrieval bin mechanism from inside the door with the security foot in its closed, shielding position.
Figure 16:
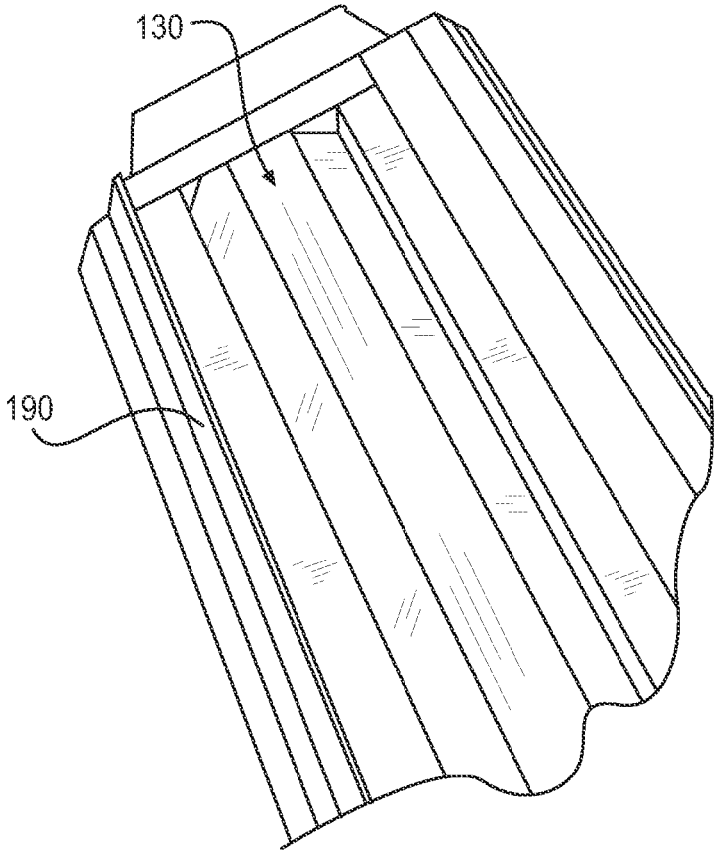
FIG. 16 shows an interior view of the fully open rotary retrieval bin mechanism.

As is also shown in FIGS. 11, 13 and 16 shield 130 will have been moved into its shielding position so as to block entry from the exterior of the vending machine into vend space 62 or into any portion of the product holding area within the interior of vending machine 10.

D. Operation

In operation, with the hopper 70 in its closed condition, when a product is selected and dispensed it will follow a path of travel, for example through a vend space as shown at 62, and eventually fall or drop into the interior of the hopper 70 of the dispensing mechanism 50 through opening 51 into hopper 70 and onto actual floor 96 therein, with the hopper opening 51 being aligned with the vend space or the path of travel. In a glass front vending machine, it will also have fallen freely through a vend space and been detected by the Sensit® system which will detect a positive vend.

Once the product has been properly vended the customer's deposited money will be accepted and the dispensing mechanism 50 can be opened so that the selected product can be collected by a customer. To accomplish that handle 86 will be grasped and moved down thereby rotating hopper 70 to its open condition at which point hopper opening 51 will become aligned with the product retrieval opening 210. The selected product will now be resting on surface 186 of the false bottom assembly 180 and at a height that is significantly higher than that of actual floor 96 on which the product was initially received after falling through the vend space. At this point the consumer can collect the vended and dispensed product. Thereafter, the hopper 70 will be returned to its closed position and be ready for the next vend cycle.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A retrieval system for a vending machine comprised of a hopper rotationally mounted therein so as to be movable between opened and closed positions, the hopper comprising;

an elongated outer shell having a hollow interior and side walls that define a hopper opening into the interior thereof and extending along a length thereof, the interior of the hopper having an actual floor on which a vended product is received at a first level when the hopper is in a closed position with the hopper opening being in an aligned orientation with a path of travel of a vended product within the vending machine;

the outer shell being positioned adjacent a product retrieval opening provided in a door of the vending machine, at least a portion of the outer shell forming a closure structure within the product retrieval opening when the hopper is in the closed position;

a handle provided on the closure structure; and an additional straight plate false bottom member separately secured within the outer shell and positioned to maintain a substantial vertical dimension across a central portion of the interior of the hopper when in the closed position and a raised technical floor of the hopper when the hopper is rotated into the open position thereby positioning the hopper opening in an aligned orientation with the product retrieval opening and presenting a vended item at a position that is higher than the first level, the additional straight plate false bottom member being secured so as to extend across the interior of the outer shell from an edge adjacent the actual floor to an edge adjacent the hopper opening;

wherein the outer shell is comprised of a plurality of interconnected discrete parts that include a molded first section, a second section formed from a portion of the false bottom and a third section with the first and third sections each having a exposed edge that define opposing edges of the hopper opening, respectively; and further including a shield member movably positioned on the hopper so as to move with the hopper into a position to close access to a product storage area within the vending machine from outside the vending machine when the hopper is in the open position.

2. The retrieval system for vending machines as in claim 1 wherein the outer shell further includes opposing end walls.

3. The retrieval system for vending machines as in claim 1 wherein the opposing end walls each include a hub assembly on an outer surface thereof.

4. The retrieval system for vending machines as in claim 3 wherein the shield member is movably retained in the hub assemblies on the opposing end walls.

5. The retrieval system for vending machines as in claim 3 further including a pair of spaced apart hopper mounting brackets fixed to an interior portion of the vending machine adjacent each of opposing ends of the retrieval opening, each of the hopper mounting brackets including an aperture therein for rotatably receiving and supporting at least a portion of the hub assembly on the opposing end walls, respectively, so that the outer shell is movably mounted there between.

6. The retrieval system for vending machines as in claim 5 wherein the shield member is movably positioned to the outer shell and the pair of hopper mounting brackets by a linkage assembly that will pivot the shield member relative to the outer shell as the hopper is moved between the opened and closed positions.

7. The retrieval system for vending machines as in claim 6 wherein the shield member is moved into a shielding position relative to the outer shell at a rate faster than the hopper is rotated into its open position.

8. A retrieval system for a vending machine comprised of a hopper rotationally mounted therein so as to be movable between opened and closed positions, the hopper comprising;

an elongated outer shell having a hollow interior and side walls that define a hopper opening into the interior thereof and extending along a length thereof, the interior of the hopper having a portion thereof defining an actual floor positioned opposite the hopper opening and on which a vended product is received at a first level when the hopper is in a closed position with the hopper opening being in an aligned orientation with a path of travel of a vended product within the vending machine;

the outer shell being positioned adjacent a product retrieval opening provided in a door of the vending machine, at least a portion of the outer shell forming a closure structure within the product retrieval opening when the hopper is in the closed position;

a handle provided on the closure structure; and a straight plate false bottom member secured within the outer shell so as to extend diagonally between an edge adjacent the actual floor and an edge of the outer shell adjacent the hopper opening and positioned to maintain a substantial vertical dimension across a central portion of the interior of the hopper when in the closed position and a raised technical floor of the hopper when the hopper is rotated into the open position thereby positioning the hopper opening in an aligned orientation with the product retrieval opening and presenting a vended item at a position that is higher than the first level.

9. The retrieval system for vending machines as in claim 8 wherein the hopper has spaced apart and opposing end walls and the straight plate false bottom member extends from end wall to end wall and is located as a chord across the hopper.

10. The retrieval system for vending machines as in claim 8 wherein, wherein the outer shell is comprised of a plurality of interconnected discrete parts, and wherein the plurality of discrete parts including a molded first section, a second section formed from a portion of the flat plate false bottom and a third section with the first and third sections each having a exposed edge that define opposing edges of the hopper opening, respectively.

11. A retrieval system for a vending machine comprised of a hopper rotationally mounted therein so as to be movable between opened and closed positions, the hopper comprising;

an elongated outer shell having a hollow interior and side walls that define a hopper opening into the interior thereof and extending along a length thereof, the interior of the hopper having an actual floor on which a vended product is received at a first level when the hopper is in a closed position with the hopper opening being in an aligned orientation with a path of travel of a vended product within the vending machine;

the outer shell being positioned adjacent a product retrieval opening provided in a door of the vending machine, at least a portion of the outer shell forming a closure structure within the product retrieval opening when the hopper is in the closed position;

a handle provided on the closure structure; and a separate flat plate false bottom member secured within the outer shell so as to extend there across from an edge adjacent the actual floor to an edge adjacent the hopper opening and positioned to maintain a substantial vertical dimension across a central portion of the interior of the hopper when in the closed position and a raised technical floor of the hopper when the hopper is rotated into the open position thereby positioning the hopper opening in an aligned orientation with the product retrieval opening and presenting a vended item at a position that is higher than the first level, wherein the outer shell is comprised of a plurality of interconnected discrete parts including a molded first section forming a portion of the outer shell and one side of the hopper opening, a second section formed from at least a portion of the flat plate false bottom and at least a portion of the actual floor, and a third section forming the remaining portion of the outer shell and the other side of the hopper opening, with the first and third sections each having an exposed edge that define opposing edges of the hopper opening, respectively.

* * * * *